United States Patent [19]

Lautzenheiser

[11] Patent Number: 4,562,515

[45] Date of Patent: Dec. 31, 1985

[54] CALIBRATED AREA SOURCE TASK LIGHT

[75] Inventor: Terry L. Lautzenheiser, Tupelo, Miss.

[73] Assignee: Emerson Electric Co., St. Louis, Mo.

[21] Appl. No.: 612,975

[22] Filed: May 23, 1984

[51] Int. Cl.[4] ..... F21V 13/00; F21S 3/00

[52] U.S. Cl. ..... 362/33; 362/127; 362/223; 362/255; 362/339

[58] Field of Search ..... 362/127, 33, 145, 217, 362/222, 223, 246, 255, 260, 311, 331, 326, 337, 339, 351, 355

[56] References Cited

U.S. PATENT DOCUMENTS

| | | | |
|---|---|---|---|
| 1,973,792 | 9/1934 | Barrows | 362/351 |
| 2,269,554 | 1/1942 | Rolph | 362/337 |
| 3,351,409 | 11/1967 | McGuire | 362/255 |
| 3,483,366 | 12/1969 | Wince | 362/337 |
| 3,532,876 | 10/1970 | Muller et al. | 362/339 |
| 3,721,818 | 3/1973 | Stahlhut | 362/297 |
| 3,988,609 | 10/1976 | Lewin | 362/339 |
| 4,054,793 | 10/1977 | Shemitz | 362/127 |
| 4,233,651 | 11/1980 | Fabbri | 362/223 |
| 4,300,185 | 11/1981 | Wakamatsu | 362/223 |
| 4,368,504 | 1/1983 | Sato et al. | 362/339 |
| 4,432,044 | 2/1984 | Lautzenheiser | 362/223 |

*Primary Examiner*—Craig R. Feinberg
*Assistant Examiner*—David A. Okonsky
*Attorney, Agent, or Firm*—Charles E. Markham

[57] ABSTRACT

A task light for mounting relatively close to an underlying work area has an elongated fluorescent bulb extending across the work area, a wide, flat and elongated prismatic lens underlying and adjacent the bulb for distributing light over the entire work area and a transparent sheet overlying the prismatic lens between the lens and the bulb having areas of various degrees of translucency calibrated to diminish the intensity of light rays directed toward certain sections of the work area contingent upon the configuration of the work area and the distance the task light is positioned therefrom.

6 Claims, 8 Drawing Figures

CALIBRATED AREA SOURCE TASK LIGHT

BACKGROUND OF THE INVENTION

This invention relates generally to task lights for locally illuminating and particularly to an improved task light which may be conveniently and economically calibrated to uniformly illuminate an entire work area when positioned relatively close thereto.

Individually operated task lights for locally illuminating work areas in a larger room permits dimming the overall ceiling illumination of the room thereby to conserve energy. Modern office furniture defines specific work areas in larger rooms and as currently constructed includes desks and tables many of which include integral cabinets or bookshelves positioned above and to the rear portion of the desk or table yet within reach of a worker sitting at the desk or table. Also, many of these desks and tables include vertical rear closure walls which frequently serve as tack boards.

Work areas which include portions thereof positioned below low overhanging cabinets or shelves require uniform, shadow free illumination throughout the entire work area. While it is convenient and is currently the practice to mount the task light on the underside of such overhanging cabinets or bookshelves, when so mounted the task light is relatively close to the underlying work area, in the order of two feet or less above the horizontal surface of the desk or table. Uniform illumination, free of glare and reflections, of an entire work area which may include horizontal and vertical surfaces located below overhanging shelves by a light mounted relatively close to the work area presents a problem to be solved.

Heretofore, prismatic lenses, reflectors and polarizing baffles have been proposed in connection with task lights to suitably illuminate portions of an entire work area. Also, a cylindrical filter arranged for rotation around an elongated fluorescent bulb has been employed to vary the brightness of illumination of a work area or a part thereof as desired by an individual.

Applicant has found that uniform, glare and reflection free illumination of an entire work area may be economically achieved when the task light is mounted relatively close to the work area. To accomplish this applicant has provided a task light having an elongated fluorescent bulb extending across the work area with a wide, flat and elongated prismatic lens adjacent the bulb for distributing light over the entire work area and in providing a transparent sheet between the lens and bulb having calibrated areas of various degrees of translucency to variously diminish the intensity of certain incident light rays and thereby effect uniform and reflection free illumination of an entire particular work area.

OBJECTS OF THE INVENTION

It is an object of this invention to provide a generally new and improved task light for uniformly illuminating an entire work area without glare or reflections when mounted close to the work area, A further object is to provide a task light which may be conveniently and economically calibrated to uniformly illuminate entire work areas of various configurations when mounted various distances therefrom;

More specifically it is an object to provide a task light having an elongated light source, an adjacent flat, elongated and relatively wide prismatic lens for distributing light over an entire work area and a transparent sheet positioned between the light source and lens having calibrated areas of translucency commensurate with the configuration of the work area and the distance of the task light from surfaces of the work area for diminishing the intensity of certain light rays.

These and other objects and advantages will become apparent when reading the following description of a preferred form of the invention in connection with the accompanying drawing.

IN THE DRAWING

DESCRIPTION OF A PREFERRED FORM OF THE INVENTION

Figure 1:
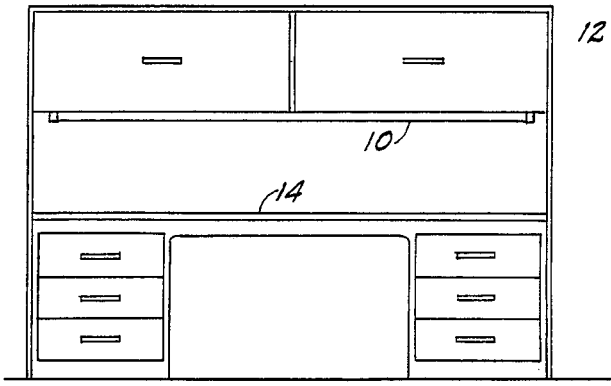
FIGS. 1 and 2 are front and side elevational views of a typical current office desk having overhanging cabinets to the underside of which is mounted a task light constructed in accordance with the present invention.
Figure 2:
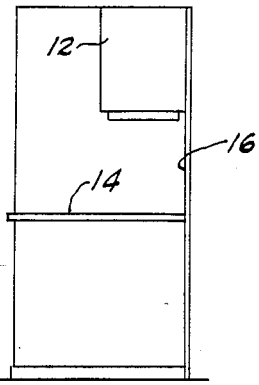
Figure 3:
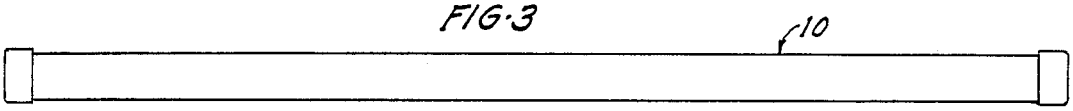
FIG. 3 is an enlarged elevational side view of the task light shown alone.

Referring to the drawing in more detail, a task light generally indicated at 10 is mounted on the horizontal underside of cabinets 12 which are positioned above a rear portion of the horizontal surface of a desk 14. The desk 14 also includes a rear vertical closure wall 16 which may serve as a tack board and is included with the horizontal surface of desk 14 as the entire work area.

The task light 10 comprises a flat, relatively wide and elongated rectangular casing 18 formed of sheet stock and having a horizontal top wall 20 lying parallel with and attached to the underside of cabinets 12. The casing 18 also has short front and rear vertical sidewalls 22 which have their lower end portions formed horizontally inward to provide ledges 24. At its ends casing 18 is equipped with closure caps 26. Spaced inward from each end of casing 18 is a transverse member 28 to which are attached the ends of an elongated fluorescent bulb 30 positioned on the longitudinal center line of the casing. Also at the ends of casing 18 are relatively short, opaque sheets 32 resting on ledges 24 and forming the bottom enclosure walls of a pair of end compartments 34 and 36 which respectfully house a lamp ballast 35 (not shown) and a dimming circuit (not shown) controlled by a slide switch 37.

Resting at its sides on ledges 24 and at its end portions on sheets 32 is an elongated, flat and relatively wide rectangular prismatic lens 38. The lens 38 has a continuous series of light distribution prisms 40 formed on its upper, light source side and has a smooth lower side facing the work area. The prisms 40 are square based pyramids with their bases aligned at acute angles to the elongated light source 30. However, they may be three sided pyramids and their apexes may be cut off slightly or pointed as shown.

Overlying and contiguous with the upper, light source side of lens 38 is a smooth surfaced transparent sheet 44 of substantially the same width and length as lens 38. The transparent sheet 44 has areas 46 and 48 of different degrees of translucency extending over a plurality of pyramids thereby to variously diminish the intensity of certain light rays incident to the upper surface of lens 38. Calibration of the shape, size, location and degree of translucency of these areas to suit variously configured work areas and the particular mounting of the task light with respect thereto will provide uniform, glare and reflection free illumination of an entire work area.

The prismatic lens 38 and transparent sheet 44 may both be constructed of a suitable transparent plastic material. The areas of various translucency on sheet 44 may be attained by applying pigment to a surface thereof as by silk screening. The surfaces of transparent sheet 44 are smooth and the application of pigment thereto by whatever means to attain areas of various degrees of translucency results in diminishing the intensity of certain light rays by partial absorption or conversion of luminous energy as opposed to diffusion.

Figure 4:
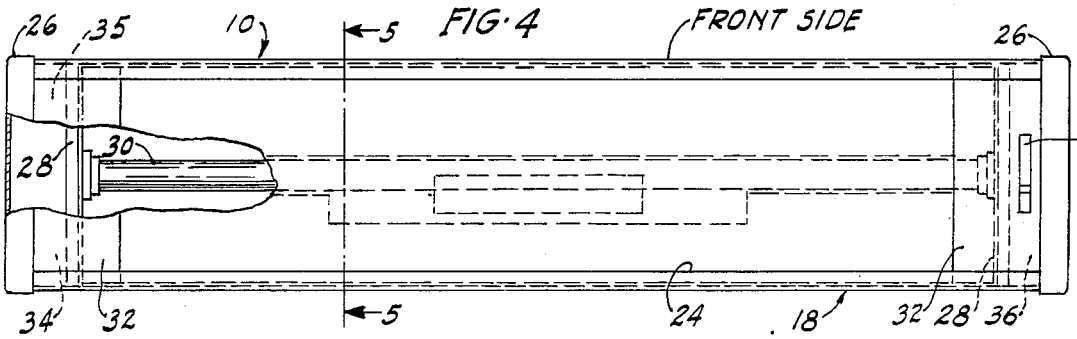
FIG. 4 is a bottom plan view of the task light shown in FIG. 3.
Figure 5:
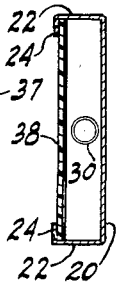
FIG. 5 is a cross-sectional view taken along line 5—5 of FIG. 4.
Figure 6:
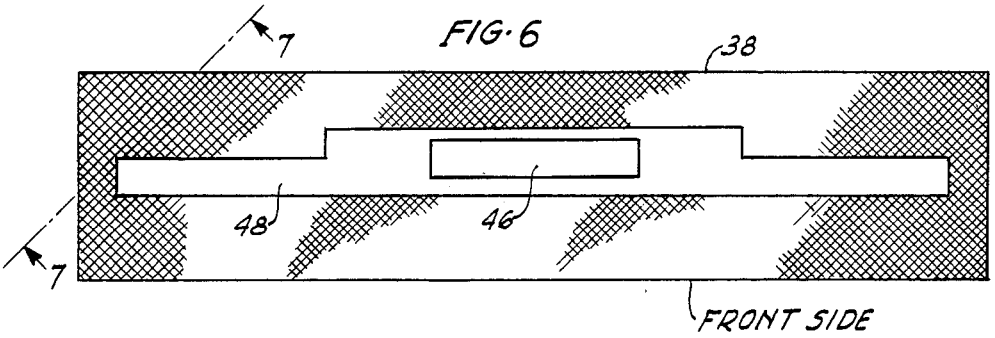
FIG. 6 is a top plan view of the prismatic lens having prisms on its upper side and a transparent sheet overlying its upper side and having discrete areas of different degrees of translucency.
Figure 7:
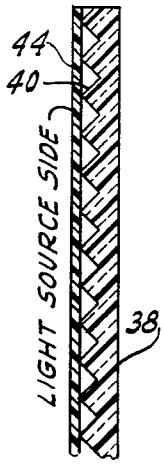
FIG. 7 is a fragmentary cross-sectional view of the prismatic lens and overlying transparent sheet and is taken on line 7—7 of FIG. 6.
Figure 8:
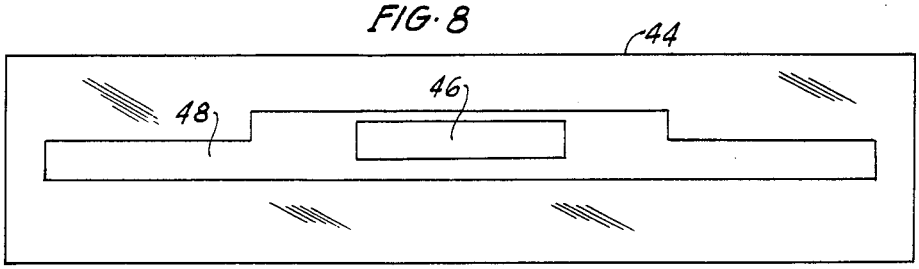
FIG. 8 is a plan view of the transparent sheet having indicated thereon discrete areas of various degrees of translucency.

In the illustrated embodiment of the invention as shown in FIGS. 4, 6 and 8 there are two elongated areas of translucency designated 46 and 48 imprinted on a surface of sheet 44 which lie generally along the longitudinal axis of the fluorescent bulb 30. The narrower, shorter transulcent area 46 permits 46% of the incident light to pass therethrough while the longer, wider translucent area 48 permits 63% of incident light to pass therethrough. A task light as described was constructed and mounted on the underside of cabinets overhanging the rear portion of a desk equipped with a rear, vertical tack board approximately two feet above the desk surface. The effective length and width of the lens 38 and light source 30 being approximately $\frac{3}{4}$ of the length and $\frac{1}{3}$ of the width of the desk surface with the areas of translucency 46 and 48 having the degree of translucency stated above and being of the proportions and location shown in the drawing. This arrangement resulted in uniform illumination of the entire horizontal desk surface and rear vertical task board without glare or reflections under conditions of variable brightness of illumination.

The degree of brightness of uniform illumination of the entire work area is varied by a multi-position sliding switch 37 which controls a dimming circuit for fluorescent lamps housed in end compartment 36 and fully disclosed in the copending application of Robert D. Munson, Ser. No. 06/594,332, filed Mar. 28, 1984 of common assignee. From the foregoing it will be seen that I have provided a task light for uniformly illuminating an entire work area when mounted relatively close to the work area which includes a prismatic lens for distributing light and a particularly economical means which may be calibrated to insure uniform illumination without glare or reflections of a particular work area.

I claim:

1. A task light for mounting on an underside of a shelf closely overhanging a work area which includes a work surface parallel with said shelf and a surface perpendicular thereto comprising; a flat, elongated, rectangular casing for mounting on the underside of said shelf, an elongated fluorescent bulb in said casing, a flat, rectangular prismatic lens in said casing having a surface facing said bulb, said lens surface having a continuous series of pyramids thereon providing inclined surfaces for dispersion of light over said work surfaces, and a smooth surfaced transparent sheet overlying said lens surface, said transparent sheet having at least two translucent areas each extending over a plurality of pyramids and having different dimensions, configurations and degrees of translucency thereby to variously diminish the intensity of certain light rays incident to said lens surface and thereby illuminate said work surfaces uniformly.

2. The task light claimed in claim 1 in which said translucent areas of said sheet are effected by applying various amounts of pigment to a surface of said sheet.

3. A task light for uniformly illuminating a local work area situated below the task light comprising an elongated casing, an elongated light source mounted in said casing, a flat prismatic lens mounted in said casing and having a surface facing said light source, said lens surface having a continuous series of protrusions thereon in the form of pyramids thereby providing inclined surfaces for dispersion of light over said work area, and a smooth surfaced transparent sheet overlying said lens surface, said sheet having a plurality of areas of different degrees of translucency each extending over a plurality of said protrusions, and said areas of different degrees of translucency being effected by applying pigment to a surface of said transparent sheet for partially reducing certain light rays incident to said lens surface thereby to uniformly illuminate said work area.

4. The task light claimed in claim 3 in which said areas of translucency are of different dimensions and configuration.

5. A task light for mounting on an underside of a shelf parallel with and relatively close to an underlying work surface; comprising a flat, elongated, rectangular casing for mounting on the underside of said shelf, an elongated fluorescent bulb in said casing, a flat, rectangular prismatic lens in said casing having a surface facing said bulb, said lens surface having a continuous series of protrusions thereon in the form of pyramids thereby providing inclined surfaces for dispersion of light over said work surface, and a smooth surfaced transparent sheet overlying said lens surface, said transparent sheet having a plurality of translucent areas each extending over a plurality of said protrusions for diminishing the intensity of certain light rays incident to said lens surface, and the degree of translucency and position of said translucent areas being altered as a distance from said task light to work surface is decreased so as to absorb a greater portion of certain light rays incident to said lens surface.

6. A task light for uniformly illuminating a local work area situated below the task light comprising an elongated flat casing, an elongated light source in said casing, a flat, elongated prismatic lens mounted in said casing and having a surface facing said light source, said lens surface having a continuous series of protrusions thereon in a form of rectangular based pyramids to provide inclined surfaces for the dispersion of light over said work area, and a smooth surfaced transparent sheet overlying said lens surface, and said sheet having a plurality of areas having different degrees of translucency thereon extending over a plurality of said protrusions for partially reducing certain light rays incident to said lens surface thereby to uniformly illuminate said work area.

* * * * *